US005270159A

United States Patent [19]

Ichikawa et al.

[11] Patent Number: 5,270,159

[45] Date of Patent: * Dec. 14, 1993

[54] PROCESS OF PRODUCING SILVER HALIDE GRAINS AND APPARATUS THEREFOR

[75] Inventors: Yasunori Ichikawa; Akira Katoh; Hiroshi Ohnishi; Shigeharu Urabe, all of Kanagawa, Japan

[73] Assignee: Fuji Photo Film Co., Ltd., Kanagawa, Japan

[ * ] Notice: The portion of the term of this patent subsequent to Nov. 7, 2006 has been disclaimed.

[21] Appl. No.: 454,238

[22] Filed: Dec. 21, 1989

[30] Foreign Application Priority Data

Dec. 26, 1988 [JP] Japan ..... 63-325980
Dec. 26, 1988 [JP] Japan ..... 63-325981

[51] Int. Cl.[5] ..... G03C 1/025; G03C 1/015
[52] U.S. Cl. ..... 430/569; 430/567
[58] Field of Search ..... 430/569, 567

[56] References Cited

U.S. PATENT DOCUMENTS 3,031,304 4/1962 Oliver ..... 430/569
3,790,386 2/1974 Posse et al. ..... 430/642
4,334,012 6/1982 Mignot ..... 430/567
4,336,328 6/1982 Brown et al. ..... 430/569
4,879,208 11/1989 Urabe ..... 430/569

FOREIGN PATENT DOCUMENTS 1243356 8/1971 United Kingdom .

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

A process and apparatus for producing silver halide grains wherein by removing water, etc., from a liquid containing fine, silver halide grains formed in a mixer and being added to a reaction vessel, the yield of the silver halide grains grown in the reaction vessel per unit amount of the raw materials used is increased. Also, by removing a portion of the water, used for the dilution, from the liquid being added to the reaction before the addition thereof, the amount of diluting water effective for the formation of silver halide fine grains in the mixer is increased, to thereby form finer silver halide grains in the mixer.

3 Claims, 2 Drawing Sheets

PROCESS OF PRODUCING SILVER HALIDE GRAINS AND APPARATUS THEREFOR

FIELD OF THE INVENTION

This invention relates to a process and apparatus for producing silver halide grains and, more particularly, to a process and apparatus for producing silver halide grains having a completely homogeneous halide composition in each silver halide crystal and having no halide distribution among the silver halide grains.

BACKGROUND OF THE INVENTION

The formation of silver halide grains is composed of two main steps, a nuclear formation (nucleation) and a crystal growth. In T. H. James, *The Theory of the Photographic Process,* 4th edition, page 89, published by Macmillan Co., 1977, it is disclosed that "[a]lthough crystallization is often considered to consist of two major processes, nucleation and growth, two additional processes occur under some conditions of photographic emulsion precipitation, Ostwald ripening and recrystallization. Nucleation is the process in which there is a population explosion of the number of crystals when entirely new crystals are created. Growth is the addition of new layers to crystals that are already present. Ostwald ripening occurs predominantly at a higher temperature, in the presence of solvents, and when there is a wide distribution of grain sizes.—Recrystallization is the process in which the composition of crystals changes." That is, since in the formation of silver halide grains, nuclei are formed at the beginning and the subsequent crystal growth mainly occurs on the existing nuclei only, the number of the silver halide grains does not increase during the growth of the grains.

Silver halide grains are generally produced by reacting an aqueous silver salt solution and an aqueous halide solution in an aqueous colloid solution contained in a reaction vessel. In this case, there is known a single jet process of placing an aqueous solution of a protective colloid, such as gelatin, and an aqueous halide solution in a reaction vessel and adding thereto an aqueous silver salt solution along with stirring for a certain time. Also known is a double jet process of placing an aqueous gelatin solution in a reaction vessel and simultaneously adding an aqueous halide solution and an aqueous silver salt solution each for a certain time. Upon comparing both of the processes with each other, in the double jet process, silver halide grains having a narrower grain size variation are obtained and, further, the halide composition can be desirably changed with the growth of the grains.

Also, it is known that the nucleus formation of silver halide grains is greatly changed by the concentration of silver ions (or halogen ions) in the reaction solutions, the concentration of a silver halide solvent, the supersaturation, the temperature, etc. In particular, the heterogeneity of a silver ion concentration or a halogen ion concentration caused by an aqueous silver salt solution and an aqueous halide solution added to a reaction vessel causes the variation of supersaturation and solubility in the reaction vessel by each concentration, thereby the nucleus formation rate differs to cause a heterogeneity in the silver halide crystal nuclei formed.

In order to avoid the occurrence of the heterogeneity described above, it is necessary to quickly and uniformly mix the aqueous silver salt solution and the aqueous halide solution being supplied to the aqueous colloid solution for homogenizing the silver ion concentration or the halogen ion concentration in the reaction vessel.

In a conventional process of adding an aqueous halide solution and an aqueous silver salt solution to the surface of an aqueous colloid solution in a reaction vessel, the portions having a high halogen ion concentration and a high silver ion concentration occur near the addition locations of the aqueous solutions, which makes it difficult to produce homogeneous silver halide grains. For improving the local deviation of the concentrations, there are known the techniques disclosed in U.S. Pat. Nos. 3,415,650 an 3,692,283 and British Patent No. 1,323,464.

In these processes, a hollow rotary mixer (filled with an aqueous colloid solution and being preferably, partitioned into upper and lower chambers by a disk-form plate) having slits in the cylindrical walls thereof is disposed in a reaction vessel filled with an aqueous colloid solution in such a manner that the rotary axis is placed in the direction of gravity. Further, an aqueous halide solution and an aqueous silver salt solution are supplied into the mixer, which is rotating at a high speed, through conduits from the upper and lower open ends and mixed quickly to react the solutions (i.e., when the mixer is partitioned into the upper and lower chambers by a partition disk, the aqueous halide solution and the aqueous silver salt solution supplied to the upper and lower chambers, respectively, are diluted with the aqueous colloid solution filled in both the chambers and then quickly mixed near the outlet slit of the mixer to cause the reaction). The silver halide grains thus formed are discharged into the aqueous colloid solution in the reaction vessel by the centrifugal force caused by the rotation of the mixer to form silver halide grains.

On the other hand, JP-B-55-10545 (the term "JP-B" as used herein means an "examined published Japanese patent application") discloses a technique of improving the local deviation of the concentrations to prevent the occurrence of the heterogeneous growth of silver halide grains. The process is a technique of separately supplying an aqueous halide solution and an aqueous silver salt solution into a mixer filled with an aqueous colloid solution from the lower open end, the mixer being placed in a reaction vessel filled with an aqueous colloid solution, abruptly stirring and mixing the reaction solutions with a lower stirring blade (turbine propeller) provided in the mixer to grow silver halide grains, and immediately discharging the silver halide grains thus grown into the aqueous colloid solution in the reaction vessel from an upper opening of the mixer by means of an upper stirring blade provided in the upper portion of the aforesaid mixer.

Also, JP-A-57-92523 (the term "JP-A" as used herein means an "unexamined published Japanese patent application") discloses a production process of silver halide grains for similarly preventing the occurrence of local heterogeneity of the concentrations. That is, there is disclosed a process of separately supplying an aqueous silver salt solution into a mixer filled with an aqueous colloid solution from a lower open end, the mixer being disposed in a reaction vessel filled with an aqueous colloid solution. The process further includes diluting both the reaction solutions with the aqueous colloid solution, abruptly stirring and mixing the reaction solutions by a lower stirring blade member provided in the mixer, and immediately discharging the silver halide grains thus grown into the aqueous colloid solution in the reaction vessel from an upper opening of the mixer. As a result, both the reaction solutions, diluted with the aqueous colloid solution as described above, are passed through a gap formed between the inside wall of the aforesaid mixer and the end of a blade of the aforesaid stirring blade member, without passing through gaps between the individual blades of the stirring blade member, so as to abruptly mix the reaction solutions due to the shearing effect in the aforesaid gap and thus cause the reaction to thereby grow silver halide grains.

However, although in the aforesaid processes, the occurrence of the local heterogeneity of the concentrations of silver ions and halogen ions in the reaction vessel can be surely prevented to a considerable extent, the heterogeneity of the concentrations still exists in the mixer and, in particular, a considerably large variation of the concentrations exists near the nozzles for supplying the aqueous silver salt solution and the aqueous halide solution, and near the lower portion and the stirring portion of the stirring blade member. Furthermore, the silver halide grains supplied to the mixer together with the protective colloid are passed through the portions having such a heterogeneous distribution of the concentrations and, more importantly, are rapidly grown in these portions. In other words, in these processes, the variation of the concentrations exists in the mixer and since the grain growth rapidly occurs in the mixer, the purpose of performing a homogeneous nucleus formation and a homogeneous grain growth of silver halide grains in a state having no variation of the concentrations has not been attained.

Furthermore, various attempts have been made for solving the problem of the heterogeneous distribution of the silver ion concentration and the halogen ion concentration by more completely mixing wherein a reaction vessel and a mixer are separately disposed and an aqueous silver salt solution and an aqueous halide solution are supplied to the mixer and abruptly mixed therein to form silver halide grains.

For example, U.S. Pat. No. 4,171,224 and JP-B-48-21045 disclose a process and an apparatus for circulating an aqueous colloid solution (containing silver halide grains) in a reaction vessel at the bottom of the reaction vessel by means of a pump, disposing a mixer in the circulating route, supplying an aqueous silver salt solution and an aqueous halide solution to the mixer, and abruptly mixing both the aqueous solutions in the mixer to form silver halide grains.

Also, U.S. Pat. No. 3,897,935 disclose a process of circulating an aqueous protective colloid solution (containing silver halide grains) in a reaction vessel at the bottom of the reaction vessel by means of a pump and adding an aqueous halide solution and an aqueous silver salt solution into the circulation system.

Furthermore, JP-A-53-47397 discloses a process and an apparatus for circulating an aqueous colloid solution (containing silver halide emulsion) in a reaction vessel by means of a pump, including first adding an aqueous alkali metal halide solution into the circulation system, and after diffusing the solution until the mixture becomes uniform, and adding an aqueous silver halide solution into the system followed by a mixing step to form silver halide grains.

However, in these processes, while the flow rate of the aqueous solution circulated in the reaction vessel and the stirring efficiency of the mixer can be separately changed, and the grain formation can be performed under a condition of a more homogeneous distribution of the concentrations, eventually, the silver halide crystals sent from the reaction vessel together with the aqueous colloid solution cause an abrupt grain growth at the inlets of the aqueous silver salt solution and the aqueous halide solution. Accordingly, it is practically impossible to prevent the formation of the variation of the concentrations at the mixing portion or near the inlets as in the case described above, and thus, the purpose of homogeneously forming silver halide grains in a state having no variation of the concentrations has not yet been attained.

Further, since in the conventional processes, the liquid (reaction mixture) containing silver halide fine grains formed in the mixer and being added to the reaction vessel contains a large amount of water and of halogen ions and nitric acid ions (they are referred to as water-soluble compounds or components in this invention), the feeding amount of the reaction mixture supplied to the reaction vessel must be increased and also the amount of desalting and water removal must be increased, and also the amount of desalting and water removal must be increased, which results in the reduction of the yield of silver halide grains formed in the reaction vessel to the raw materials supplied.

SUMMARY OF THE INVENTION

An object of the present invention is to solve the aforesaid problems with respect to nucleus formation and/or crystal growth in the heterogeneous field of the concentrations (of silver ions and halogen ions) in the aforementioned conventional production techniques and the formation, thereby, of heterogeneous silver halide grains (grain sizes, crystal habit, the halogen distribution among and in the silver halide grains).

A further object of this invention is to provide a process and apparatus for producing silver halide grains wherein by removing water, etc., from the liquid containing fine, silver halide grains formed in the mixer and being added to the reaction vessel, the yield of the silver halide grains grown in the reaction vessel per unit amount of the raw materials used is improved. Also, by removing a part of the water, used for the dilution, from the liquid being added to the reaction before the addition thereof, the amount of diluting water effective for the formation of silver halide fine grains in the mixer is, on the contrary, increased, thereby finer silver halide grains are formed in the mixer.

For solving the aforesaid object, the inventors previously proposed "a process of performing a nucleus formation of silver halide grains" in a reaction vessel by disposing a mixer outside of the reaction vessel for causing the nucleus formation and the crystal growth of silver halide grains including the steps of forming silver halide grains, supplying an aqueous solution of a water-soluble silver salt and an aqueous solution of water-soluble halide(s) into the mixer and mixing them to form silver halide, fine grains, and immediately supplying the fine grains into the reaction vessel (Japanese Patent Application 63-195778). Further, "a process of causing the crystal growth of silver halide grains" in the same manner as above was proposed (Japanese Patent Application 63-7851). In the case of performing the reaction for forming silver halide, fine grains in a mixer in these conventional processes, it is important that the reactant solutions are reacted while being diluted with water or an aqueous protective colloid solution. However, it is impossible to increase the amount of the diluting solution to a desired extent by the restrictions of the reaction vessel and, hence, the yield for the formation of silver halide fine grains per unit amount of the reactant solutions is low. Thus, an alternative solution to the problem has been required. The present invention relates to an improvement of these inventions.

That is, it has now been discovered that the aforesaid object can be achieved by the present invention as described hereinbelow.

Thus, according to this invention, there is provided a process of producing silver halide grains by disposing a mixer having a stirrer outside of a reaction vessel containing an aqueous protective colloid solution and for causing a nucleus formation (nucleation) and a crystal growth of silver halide grains. The process further includes the steps of: supplying an aqueous solution of a water-soluble silver salt, an aqueous solution of water-soluble halide(s), and an aqueous solution of a protective colloid to the mixer while controlling the flow rates of the solutions; mixing them while controlling the rotational speed of a stirrer of the mixer to form fine, silver halide grains; and immediately supplying the fine grains into the reaction vessel to perform the nucleus formation and the crystal growth of the silver halide grains in the reaction vessel. The process further comprises mixing the reaction mixture being supplied from the mixer through a conduit to the reaction vessel with a solution drawn from the reaction vessel and added to the conduit extending between the mixer and the reaction vessel, and after removing part of the water and the water-soluble components from the mixture, supplying the mixture to the reaction vessel.

According to another aspect of this invention, a part of the water and the water-soluble components may be removed from the reaction mixture being supplied to the reaction vessel and also removed from the solution drawn from the reaction vessel before they are mixed.

A feature of this invention is that the reaction mixture being supplied from the mixer to the reaction vessel is concentrated for shortening the distance between the silver halide grains in the reaction vessel in order to increase the growing rate of the fine grains added to the reaction vessel. A further feature is that for efficiently performing the concentration of the reaction mixture, a solution in the reaction vessel is circulated and mixed with the reaction mixture from the mixer and part of the water and water-soluble components, such as water-soluble silver ions and halogen ions, are removed by a ultrafiltration device or a semipermeable membrane device disposed between the mixer and the reaction vessel or are removed before entering the mixer. Also, for increasing the efficiency of the removal, the inside pressure of the removing device or the removing flow rate can be controlled by detecting the same and using a control valve disposed at the discharging side of the removing device.

According to a further embodiment of the invention, there is provided a process of producing silver halide grains by disposing a mixer having a stirrer outside of a reaction vessel containing an aqueous protective colloid solution and for causing a nucleus formation (nucleation) and/or a crystal growth of silver halide grains. The process further includes supplying an aqueous solution of a water-soluble silver salt, an aqueous solution of water-soluble halide(s), and an aqueous solution of a protective colloid to the mixer while controlling the flow rates of the aqueous solutions; mixing the aqueous solutions while controlling the rotational speed of the stirrer to form fine, silver halide grains; and immediately supplying the fine grains to the reaction vessel to perform the nucleus formation and/or the crystal growth of silver halide grains. The process further comprises removing a part of the water and the water-soluble compounds from the liquid containing the fine grains supplied from the mixer before entering the reaction vessel and supplying the liquid thus concentrated to the reaction vessel.

Also, according to a still further embodiment of this invention, there is provided an apparatus for producing silver halide grains comprising: a reaction vessel for causing a nucleus formation and a crystal growth of silver halide grains; a mixer having a stirrer and being disposed outside of the reaction vessel; means for supplying an aqueous solution of a water-soluble silver salt, an aqueous solution of water-soluble halide(s), and an aqueous solution of a protective colloid to the mixer while controlling the flow rates of these solutions; a means for controlling the rotational speed of the stirrer; and a concentrating means for removing a portion of water and water-soluble components contained in the reaction mixture supplied from the mixer, the concentrating means being disposed in a conduit connecting the mixer to the reaction vessel for immediately supplying the reaction mixture formed in the mixer to the reaction vessel.

Thus, a further feature of this invention is in that after forming fine, silver halide grains in the mixer disposed outside of the reaction vessel, a portion of water and water-soluble components, such as water-soluble halogen ions and nitric acid ions, is removed from the reaction mixture containing the fine grains discharged from the mixer before being added to the reaction vessel using an ultrafiltration membrane, semipermeable membrane, etc.

Furthermore, in this invention, the efficiency for removing water, etc., from the reaction mixture is increased by detecting the inside pressure of the membrane and controlling the pressure by means of a control valve. Also, a definite amount of water, etc., may be removed by measuring the flow rate of the liquid discharged from the membrane and controlling the opening of a control valve.

DETAILED DESCRIPTION OF THE INVENTION

The term "nuclei", in this invention, means newly forming silver halide grains during the formation of the silver halide grains and in a stage of changing the number of the silver halide crystals, and such silver halide grains which are in a stage of causing only the growth of nuclei, without changing the number of silver halide crystals, are referred to as grains causing the growth only.

In the step of the nucleus formation, the generation of new nuclei, the dissolution of already existing nuclei, and also the growth of nuclei occur simultaneously.

In the practice of the nucleus formation and/or the grain growth by the invention, it is important that the aqueous silver halide solution and the aqueous halide solution are not added to the reaction vessel, and that the aqueous protective colloid solution (containing silver halide grains) in the reaction vessel is not recycled into the mixer. Thus, the process and apparatus of this invention are completely different from conventional systems and are a novel process and apparatus for obtaining homogeneous silver halide grains.

Figure 1:
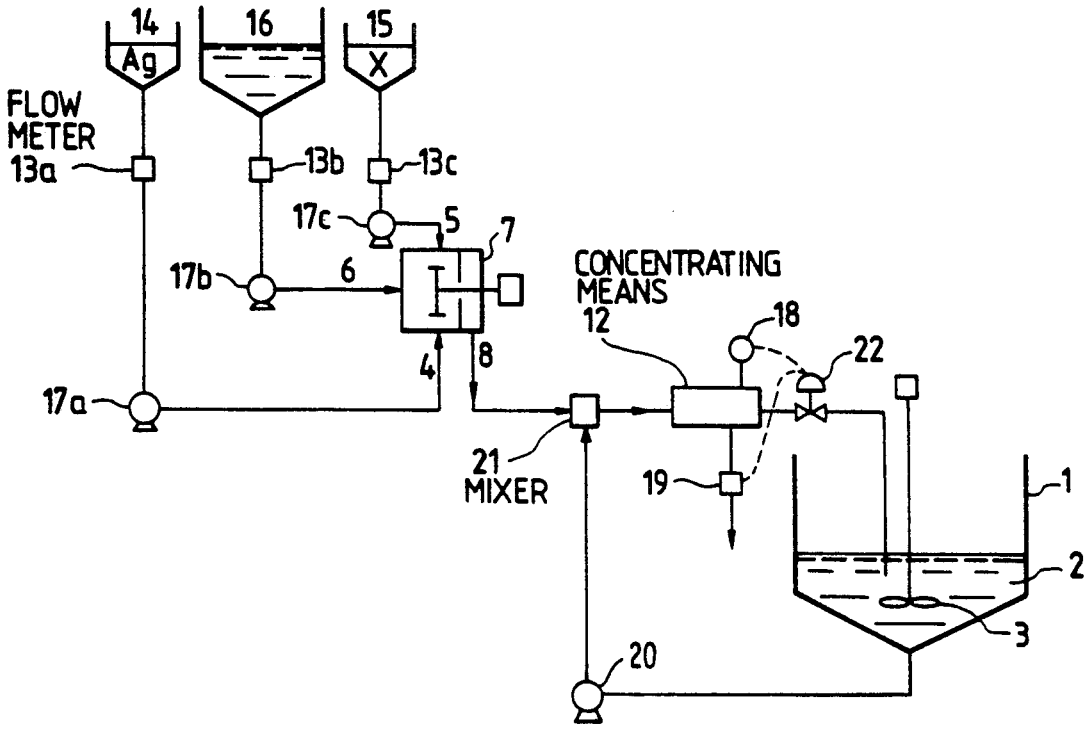
FIGS. 1 is a system flow diagram showing an embodiment of the production process of this invention.
Figure 2:
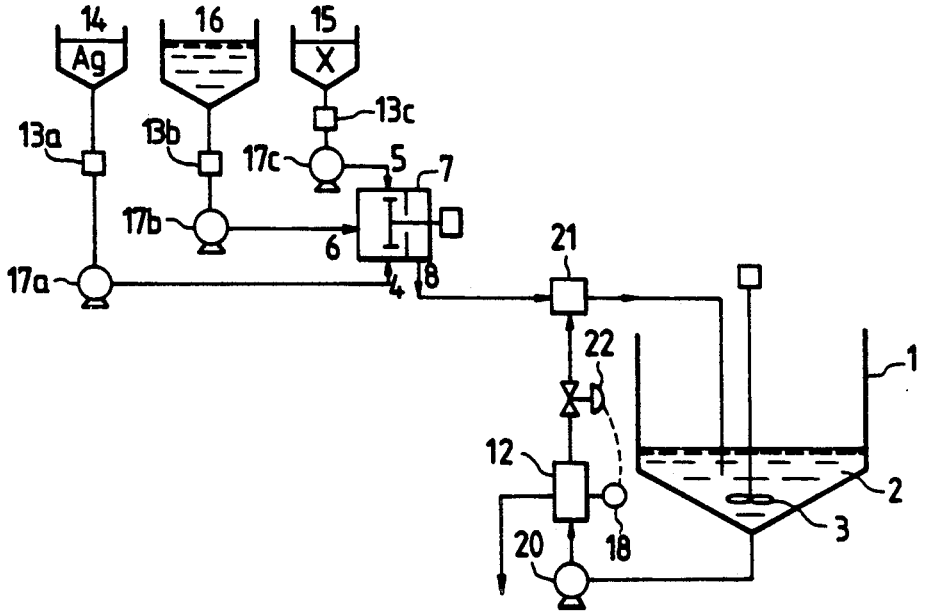
FIG. 2 is a system flow diagram showing another embodiment of this invention.

The process of producing silver halide grains of this invention is explained by referring to the systems shown in FIG. 1 and FIG. 2.

In the systems shown in FIG. 1 and FIG. 2, a reaction vessel 1 is provided for containing an aqueous protective colloid solution 2 and a propeller or blade 3 disposed on a rotary shaft for stirring the aqueous protective colloid solution. An aqueous silver salt solution, an aqueous halide solution, and an aqueous protective colloid solution prepared in tanks 14, 15, and 16, respectively, are introduced into a mixer 7 disposed outside of the reaction vessel 1 by addition systems or conduits 4, 5, and 6, respectively. In this case, the aqueous silver salt solution and the aqueous halide solution may be previously diluted with an aqueous protective colloid solution before being supplied to the mixer 7. These solutions are quickly and strongly mixed in the mixer to form fine, silver halide grains and the reaction mixture is immediately supplied to the reaction vessel 1 by a supplying system or conduit 8.

In this case, in the system of FIG. 1, the reaction mixture from the mixer 7 is mixed in an additional mixer 21 with a solution drawn from the reaction vessel 1 by a pump 20 and, after being passed through a means 12 for removing part of the water and the water-soluble components (removing device) from the mixture, the mixture is supplied to the reaction vessel 1. Or, in the system of FIG. 2, the solution drawn from the reaction vessel 1 by a pump 20 is passed through a means 12 for removing part of the water and the water-soluble components, then is mixed in an additional mixer 21 with the reaction mixture from the mixer 7, and the resultant mixture is supplied to the reaction vessel 1.

In each of the above-mentioned embodiments, the means 12 for removing part of the water and the water-soluble components may take the form of, .for example, an ultrafiltration module or a semipermeable membrane. Also, a control valve 22 for flow rate control, which is capable of removing a predetermined amount of the components to be removed by controlling the inside pressure of the removing means 12 by means of a pressure gauge 18 or by detecting the flow rate of the components being removed by means of a flow meter 19, is formed for controlling the removing efficiency to thereby control the removing ratio.

Figure 3:
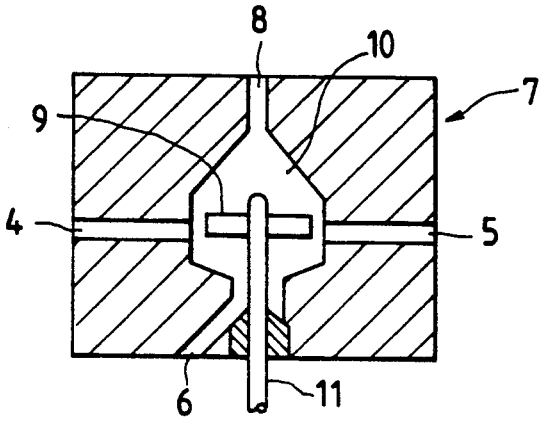
FIG. 3 is cross-sectional view of an embodiment of a mixer for use in this invention.

FIG. 3 shows the details of an embodiment of the mixer 7 for use in this invention.

A reaction chamber 10 is formed in the mixer 7 and has therein a stirring blade 9 disposed on a rotary shaft 11. An aqueous silver salt solution, an aqueous halide solution, and an aqueous protective colloid solution are added to the reaction chamber 10 through the three inlet conduits (i.e., 4 and 5, and another conduit 6 which is not shown in FIG. 3). By rotating the rotary shaft 11 at a high speed (i.e., higher than about 1000 r.p.m., preferably higher than about 2000 r.p.m., and more preferably higher than about 3000 r.p.m.), the mixture in the mixer 7 is quickly and strongly mixed to form very fine silver halide grains and the solution containing the fine grains is immediately supplied to the reaction vessel from the supply conduit 8.

In this case, the aqueous silver salt solution, the aqueous halide solution, and the aqueous protective colloid solution are supplied from the tanks 14, 15, and 16 to the mixer 7 through flow meters 13*a*, 13*c*, and 13*b* for controlling the flow rate of feed pumps 17*a*, 17*c*, and 17*b*, respectively.

The fine grains formed in the mixer 7 are mixed with the solution circulated from the reaction vessel before they are introduced into the reaction vessel 1, and these solutions are concentrated by removing a part of the water and the water-soluble components therefrom before or after mixing and then supplied to the reaction vessel.

The fine grains supplied to the reaction mixture are easily dissolved since the grain sizes thereof are very fine and the solution containing the fine grains has been concentrated to form silver ions and halogen ions again to thereby cause the homogeneous nucleus formation and/or crystal growth.

The halide composition of the very fine silver halide grains is selected to be same as the halide composition of the desired silver halide grains. The fine grains introduced into the reaction vessel 1 are dispersed throughout the solution in the reaction vessel and halogen ions and silver ions of the desired halide composition are released from each fine grain. The size of the grains formed in the mixer 7 is very fine, the number of the grains is very large, and since the silver ions and halogen ions (in the case of growing mixed crystals, the composition of the halogen ions is same as the desired halogen ion composition) are released from such a large number of grains and the release thereof occurs throughout the entire protective colloid in the reaction vessel, the result is completely homogeneous nucleus formation and crystal growth.

In this case, it is important that the silver ions and the halogen ions are not added to the reaction vessel 1 as aqueous solutions, and that the aqueous protective colloid solution in the reaction vessel 1 is not recycled into the mixer 7.

With respect to the aforesaid point, the process of this invention is completely different from conventional processes and can have an astonishing effect on the nucleus formation and the crystal growth of silver halide grains.

Figure 4:
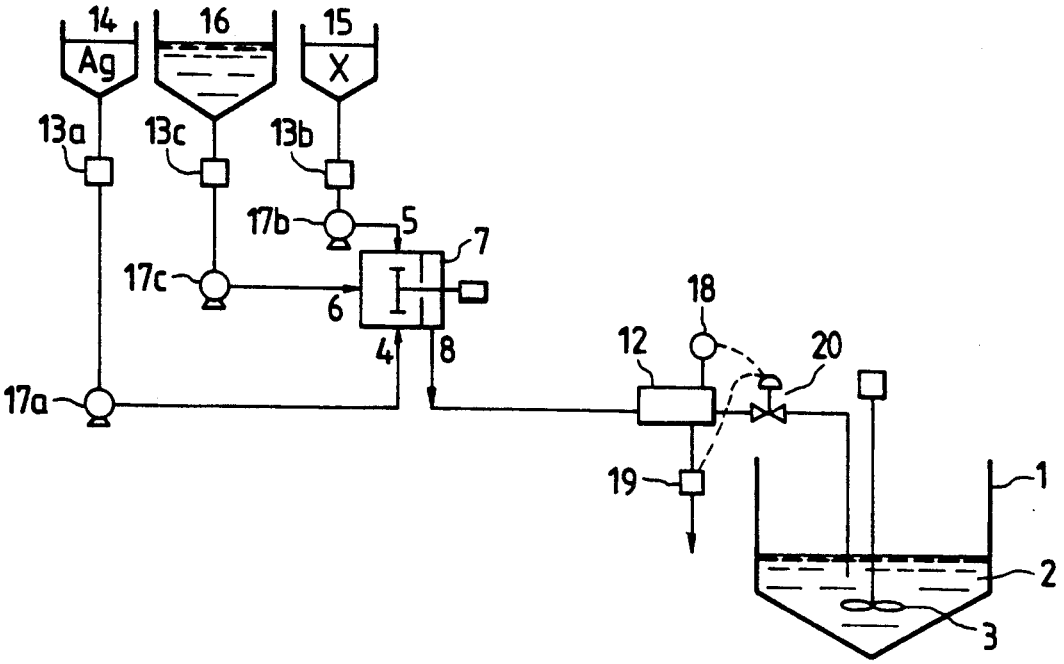
FIG. 4 is a system flow diagram showing the process and apparatus according to a still further embodiment of this invention for producing silver halide grains.

In FIG. 4, a reaction vessel 1 contains an aqueous protective colloid solution 2 and a propeller 3 disposed on to a rotary shaft for stirring the aqueous protective colloid solution. An aqueous silver salt solution, an aqueous halide solution, and an aqueous protective colloid solution are introduced into a mixer 7 disposed outside of the reaction vessel 1 by addition systems or conduits 4, 5, and 6, respectively. In this case, the aqueous silver salt solution and the aqueous halide solution may be diluted with the aqueous protective colloid solution before being introduced into the reaction vessel 1. These solutions are quickly and strongly mixed in the mixer 7 to form silver halide, fine grains and the reactions mixture formed is immediately introduced into the reaction vessel 1 through a conduit 8. In this case, part of the water and the water-soluble compounds or components, are removed from the liquid (reaction mixture)

containing the fine grains by a concentration means 12 before supplying the liquid to the reaction vessel 1.

The reaction mixture containing the very fine silver halide grains formed in the mixer 7 is concentrated by passing the same through a concentrating means 12, such as an ultrafiltration device or a device using a semipermeable membrane, to remove part of the water and the water-soluble compounds contained in the reaction mixture, after the same has been discharged from the mixer 7. Then, the mixture is introduced into the reaction vessel 1. The concentration device 12 is controlled as follows. That is, the inside pressure of the device or the flow rate of the liquid being concentrated by the device is detected, and the flow rate is controlled by a control valve 20 disposed at the discharge side of the device 12. The inside pressure is detected by a pressure detecting means 18 such as a pressure gauge, a pressure sensor, etc., and the flow rate is detected by a flow rate detector 19 such as an oval flow meter, an electromagnetic flow meter, etc.

The mixer 7 may again take the form of the embodiment as shown in FIG. 3 and described in detail above.

Thus, since the grain sizes of the silver halide grains introduced into the reaction vessel from the mixer are very fine, these grains are easily dissolved to form silver ions and halogen ions again and perform the homogeneous nucleus formation and crystal growth. The halide composition of the very fine silver halide grains is selected to be same as the halide composition of desired silver halide grains. In this case, since the grain sizes of the silver halide grains formed in the mixer 7 are very fine, as described above, and the number of the fine grains is very large, and since the silver ions and halogen ions are released from such a large number of fine grains throughout the entire protective colloid solution in the reaction vessel 1, the result is completely homogeneous nucleus formation and crystal growth.

It is important that silver ions and halogen ions are not added to the reaction vessel as aqueous solutions thereof, and that the aqueous protective colloid solution in the reaction vessel 1 is not recycled into the mixer 7. The present invention is completely different from conventional processes and apparatuses for producing silver halide grains in the aforesaid points, and the invention can have an astonishing effect on the nucleus formation and the homogeneous crystal growth of silver halide grains.

The fine grains formed in the mixer have a very high solubility since the grain sizes thereof are very fine and are easily dissolved to form silver ions and halogen ions again when they are added to the reaction vessel. Hence, the ions are deposited on a very slight part of the fine grains thus introduced into the reaction vessel to form silver halide nuclei and to accelerate the crystal growth, but the fine grains together cause so-called Ostwald ripening due to the high solubility to increase the grain sizes.

In this case, if the size of the fine, silver halide grains being introduced into the reaction vessel are increased, the solubility of the grains is lowered to delay the dissolution thereof in the reaction vessel, which results in greatly reducing the nucleus formation rate. In some cases, the grains can no longer be dissolved, thereby an effective nucleus formation cannot be performed and, on the contrary, the grains themselves become nuclei to cause grain growth.

In this invention, the problem is solved by the following these techniques:

(1) After forming fine grains in the mixer, the grains are immediately added to the reaction vessel.

As will be described below, it is known that fine grains are previously formed to provide a fine grain silver halide emulsion, thereafter, the emulsion is re-dissolved, and the dissolved fine grain emulsion is added to a reaction vessel containing silver halide grains becoming nuclei and a silver halide solvent to cause the grain formation. However, in such a process, the very fine grains once formed cause Ostwald ripening in the step of grain formation, the step of washing, the step of re-dispersion, and the step of re-dissolution to increase the grain size.

In this invention, the occurrence of Ostwald ripening is prevented by disposing a mixer at a position very near the reaction vessel and shortening the residence time of the added solutions in the mixer, that is, by immediately adding the fine grains formed in the mixer to the reaction vessel. Practically, the residence time t of the solutions added to the mixer is shown by the following equation:

$$t = \frac{v}{a + b + c}$$

V: Volume (ml) of the reaction chamber of the mixer.
a: Addition amount (ml/min.) of an aqueous silver nitrate solution.
b: Addition amount (ml/min.) of an aqueous halide solution.
c: Addition amount (ml/min.) of an aqueous protective colloid solution.

(In this invention, however, the amount c contains the amount of the aqueous protective colloid solution previously used for diluting the aqueous silver nitrate solution and the aqueous halide solution.)

In the production process of this invention, the residence time t is not longer than 10 minutes, preferably not longer than 5 minutes, more preferably not longer than 1 minute, and particularly preferably not longer than 20 seconds. The fine grains thus obtained in the mixer are immediately added to the reaction vessel without increasing the grain sizes.

From the aforesaid viewpoint, the control of the flow rates of an aqueous silver salt solution, an aqueous halide solution, and an aqueous protective colloid solution plays an important role in this invention. One of the features of this invention is in this aspect, namely the flow rate of the sum of the aforesaid addition amounts a, b, and c is controlled by keeping each addition amount (rate) a, b, or c constant or by keeping the ratios of them constant.

(2) The solutions are stirred strongly and efficiently in the mixer.

In T. H. James, *The Theory of the Photographic Process*, page 93, he discloses that "[a]nother type of grain growth that can occur is coalescence ripening. In coalescence ripening, an abrupt change in size occurs when pairs or larger aggregates of crystals are formed by direct contact and are welded together from crystals that were widely separated. Both Ostwald and coalescence ripening may occur during precipitation, as well as after precipitation has stopped."

The coalescence ripening described above is liable to occur when the grain sizes are very small and is liable to occur when stirring is insufficient. In the extreme case, the silver halide grains sometimes form coarse massive grains. On the other hand, in this invention, since a closed type mixer as shown in FIG. 3 is used, the stirring blade in the reaction chamber can be rotated at a high rotational speed. High speed stirring has never been practiced in the conventional open type reaction vessel (in the open type reaction vessel, when a stirring blade is rotated at a high rotational speed, the liquid in the vessel is scattered away and foam is formed by centrifugal force, which makes is practically impossible to use such as system). The present invention prevents the occurrence of the aforesaid coalescence ripening, thereby allowing silver halide grains having very fine grain sizes to be obtained.

In this invention, the rotation number or speed of the stirring blade is at least 1,000 r.p.m., preferably at least 2,000 r.p.m., and more preferably at least 3,000 r.p.m.

Accordingly, the control of the rotation number of the stirring blade in the mixer plays an important role.

(3) Injection of an aqueous protective colloid solution into the mixer.

The occurrence of the aforesaid coalescence ripening can be remarkably prevented by a protective colloid for the fine, silver halide grains. In this invention, the aqueous protective colloid solution is added to the mixer by the following method.

(a) The aqueous protective colloid solution is separately added to the mixer.

The concentration of the protective colloid is at least 0.2% by weight, and preferably at least 0.5% by weight and the flow rate of the aqueous protective colloid solution is at least 20%, preferably at least 50%, and more preferably at least 100% of the sum of the flow rate of the aqueous silver nitrate solution and the flow rate of the aqueous halide solution being added to the mixer. In the present invention, this method is employed.

(b) The protective colloid is contained in the aqueous halide solution being added to the mixer.

The concentration of the protective colloid is at least 0.2% by weight, and preferably at least 0.5% by weight.

(c) The protective colloid is contained in the aqueous silver nitrate solution being added to .the mixer.

The concentration of the protective colloid is at least 0.2% by weight, and preferably at least 0.5% by weight. When gelatin is used as the protective colloid, since gelatin silver may be formed from silver ions and gelatin, if the mixture is stored for a long time, and silver colloid may be formed by the photodecomposition and/or the thermal decomposition thereof, it is preferred to mix the aqueous silver salt solution and the aqueous gelatin solution directly before use.

Also, as to the aforesaid methods (a), (b), and (c), the method (a) may be used singly, a combination of the methods (a) and (b) or the methods (a) and (c), or a combination of the methods (a), (b), and (c) may be used.

In this invention, gelatin is usually used as the protective colloid but other hydrophilic colloids can also be used. Practically, the hydrophilic colloids which can be used in this invention are described in *Research Disclosure*, Vol. 176, No. 17643, Paragraph IX (December, 1978).

The grain sizes obtained by the aforesaid techniques (1) to (3) can be confirmed on a mesh by a transmission type electron microscope and in this case, the magnification is from 20,000 to 40,000 magnifications.

The sizes of the fine grains obtained by the process of this invention are not larger than 0.06 μm, preferably not larger than 0.03 μm, and more preferably not larger than 0.01 μm.

U.S. Pat. No. 2,146,938 discloses a method of forming a coarse grain silver halide emulsion by mixing coarse silver halide grains having adsorbed thereto no adsorptive material and fine, silver halide grains having adsorbed thereto no adsorptive material or by slowly adding a fine grain silver halide emulsion to a coarse grain silver halide emulsion. In the method, the fine grain emulsion previously prepared is added and thus the process is completely different from the process of this invention.

Also, U.S. Pat. No. 4,379,837 discloses a process of growing silver halide grains by washing and dispersing a fine grain silver halide emulsion prepared in the presence of a grain growing inhibitor, re-dissolving the emulsion, and adding the dissolved emulsion to silver halide grains being grown. But the process is also completely different from the process of this invention for the same reason as described above.

T. H. James, *The Theory of the Photographic Process*, 4th edition, cites a Lippmann emulsion as a fine grain silver halide emulsion and describes that the mean grain size is 0.05 μm. It is possible to obtain fine silver grains having a mean size of not larger than 0.05 μm, but even if such fine grains are obtained, the grains are unstable and the grain sizes are easily increased by Ostwald ripening. When an adsorptive material is adsorbed on fine grains as in the process disclosed in U.S. Pat. 4,379,837, the occurrence of Ostwald ripening may be prevented to some extent, but the dissolution speed of the fine grains is reduced by the presence of the adsorptive material, which is contrary to the intention of this invention.

U.S. Pat. Nos. 3,317,322 and 3,206,313 disclose a process of forming core/shell grains by mixing a chemically sensitized emulsion of silver halide grains having a mean grain size of at least 0.8 μm, which are to be the cores, with an emulsion of silver halide grains, which are not chemically sensitized and which have a mean grain size of not larger than 0.4 μm, to perform the ripening. However, the process is completely different from the process and apparatus of the present invention since in the aforesaid process, the fine grain emulsion is a silver halide emulsion previously prepared and ripening is performed by mixing two kinds of silver halide emulsions.

JP-A-62-99751 discloses a photographic element containing tabular silver bromide or silver iodobromide emulsion having a mean grain size of from 0.4 to 0.55 μm and having an aspect ratio of at least 8. Also, U.S. Pat. No. 4,672,027 discloses a photographic element containing tabular silver bromide or silver iodobromide emulsion having a mean grain size of from 0.2 to 0.55 μm, but in the growth of tabular silver iodobromide grains described in the examples, the tabular silver iodobromide grains are grown by adding an aqueous silver nitrate solution and an aqueous bromide solution to a reaction vessel containing an aqueous solution of a protective colloid (bone gelatin) by a double jet method and simultaneously supplying iodine as a silver iodide emulsion (mean grain size of about 0.05 μm, bone gelatin 40 g/mol-Ag). In the process, an aqueous silver nitrate solution and an aqueous halide solution are added to a reaction vessel simultaneously with the addition of silver halide, fine grains and, hence, the process is completely different from the process and apparatus of this invention.

In U.S. Pat. No. 4,457,101, it is disclosed that "silver, a bromide, and an iodide can be introduced at the beginning or in the growing state as a form of fine silver halide grains dispersed in a dispersion medium. That is, silver bromide grains, silver iodide grains and/or silver iodobromide grains can be introduced."

However, the above description is only a general description of using a fine grain emulsion for the formation of silver halide and does not show the process and the system of the present invention.

JP-A-62-124500 discloses an example of growing host grains in a reaction vessel using very fine silver halide grains previously prepared, but in the process, a fine grain silver halide emulsion previously prepared is added and, hence, the process is completely different from the process and apparatus of the present invention.

In addition, U.S. Pat. No. 4,336,328, U.S. Pat. No. 4,758,505, and PCT Japanese Publication (unexamined) 56-501776 disclose a process of concentrating a liquid contained in a reaction vessel for growing silver halide grains in the case of circulating the liquid (aqueous protective colloid solution) for diluting an aqueous silver salt solution and an aqueous halide solution being supplied to the reaction vessel. However, in these inventions, a mixer for forming silver halide fine grains by mixing an aqueous silver salt solution, an aqueous halide solution, and an aqueous protective colloid solution prepared in a tank (i.e., not from a reaction vessel) is not used and, hence, these inventions are also completely different from the present invention.

In the conventional processes described above, since a fine grain silver halide emulsion is previously prepared and the emulsion is re-dissolved for use, silver halide grains having fine grain sizes cannot be obtained. Accordingly, these grains having relatively large grain sizes cannot be quickly dissolved in a solution in a reaction vessel, and a very long period of time or a large amount of silver halide solvent is required for completing the dissolution thereof. In such a circumstance, the nucleus formation is performed at a very low supersaturation for the grains being grown in a vessel, which results in greatly broadening the grain size distribution of the nuclei and thus causing the reduction of properties such as the broadening of the grain size distribution of silver halide grains formed, the reduction of the photographic gradation, the reduction of sensitivity by the heterogeneous chemical sensitization (it is impossible to most suitably chemically sensitize silver halide grains having large grain sizes and silver halide grains having small grain sizes simultaneously), the increase of fog, the deterioration of graininess, etc.

Furthermore, in the conventional processes, there are many steps including grain formation, washing, dispersion, cooling, storage, and re-dispersion, thereby the production costs become high and also there are many restrictions on the addition system for an emulsion as compared with the addition system for other solutions.

These problems can be solved by the process and apparatus of this invention. That is, since very fine grains are introduced into the reaction vessel by the process of this invention, the solubility of the fine grains is high, thereby the dissolution rate is high and the grains being grown in the reaction vessel cause the nucleus formation and/or the crystal growth under a high super-saturation condition. Accordingly, the size distribution of the nuclei and/or the crystal grains formed is not broadened. Furthermore, since the fine grains formed in the mixer are added to the reaction vessel as disclosed, there is no problem with the production cost.

When a silver halide solvent is used in the reaction vessel in the process of this invention, a far higher dissolution rate of fine grains and a far higher nucleation rate and crystal growing rate of grains in the reaction vessel is obtained.

As a silver halide solvent, there are a water-soluble bromide, a water-soluble chloride, a thiocyanate, ammonia, a thioether, a thiourea, etc.

For example, there are thiocyanates (described in U.S. Pat. Nos. 2,222,264, 2,448,534 and 3,320,069), ammonia, thioether compounds (described in U.S. Pat. Nos. 3,271,157, 3,574,628, 3,704,130, 4,297,439, and 4,276,345), thione compounds (described in JP-A-53-144319, 53-82408, and 55-77737), amine compounds (described in JP-A-54-100717), thiourea derivatives (described in JP-A-55-2982), imidazoles (described in JP-A-54-100717), and substituted mercaptotetrazoles (described in JP-A-57-202531).

According to the process and apparatus of this invention, the supplying rates of silver ions and halide ions to the mixer may be desirably controlled. The supplying rates may be constant, but it is preferred to gradually increase the supplying rates. Such methods are described in JP-B-48-36890 and U.S. Pat. No. 3,672,900.

Furthermore, according to the process and apparatus of this invention, the halogen composition during the crystal growth may be controlled. For example, in the case of silver iodobromide, it is possible to maintain a definite content of silver iodide, continuously increase the content of silver iodide, continuously decrease the content of silver iodide, or change the content of silver iodide after a certain time.

The reaction temperature in the mixer is .not higher than 60° C., preferably not higher than 50° C., and more preferably not higher than 40° C.

With a reaction temperature of lower than about 35° C, ordinary gelatin is liable to coagulate and it is preferred to use a low molecular weight gelatin (mean molecular weight of less than about 30,000).

Such a low molecular weight gelatin which is preferably used in this invention, can usually be prepared as follows. Ordinary gelatin having a mean molecular weight of about 100,000 is dissolved in water and then the gelatin molecule is enzyme-decomposed by adding thereto a gelatin decomposing enzyme. For the method, the description of R. J. Cox, *Photographic Gelatin II*, pages 233–251 and 335–346, Academic Press, London 1976, can be referred to.

In this case, since the bonding position of gelatin decomposed by the enzyme occurs at a specific structural position, low molecular weight gelatin having a relatively narrow molecular weight distribution is obtained. In this case, as the enzyme decomposition time is longer, a lower molecular weight of gelatin is obtained.

In another method of obtaining low molecular weight gelatin, ordinary gelatin is hydrolized by heating at low pH (e.g., pH 1 to 3) or high pH (e.g., pH 10 to 12).

The temperature of the protective colloid solution in the reaction vessel is higher than about 40° C., preferably higher than 50° C., and more preferably higher than about 60° C.

In this invention, an aqueous silver salt solution and an aqueous halide solution are not added to the reaction vessel during the nucleus formation and/or the crystal growth, but prior to the nucleus formation, an aqueous halide solution or an aqueous silver salt solution can be added to the reaction vessel for controlling pAg of the solution in the reaction vessel. Also, an aqueous halide solution or an aqueous silver salt solution can be added (temporarily or continuously) to the reaction vessel for controlling pAg of the solution in the reaction vessel during the formation of nuclei. Also, if necessary, an aqueous halide solution or an aqueous silver salt solution can be added to the reaction vessel by a so-called pAg control double jet method for keeping a constant pAg of the solution in the reaction vessel.

The control process and apparatus of this invention are very effective for the production of various kinds of emulsions.

In the nucleus formation and/or grain growth of mixed crystal silver halide grains such as silver iodobromide, silver iodobromo-chloride, silver iodochloride, and silver chlorobromide, a microscopic heterogeneity of a halide composition is formed in the case of conventional production processes. Further, the occurrence of such a heterogeneity cannot be avoided even by performing the nucleus formation and/or the crystal growth by adding an aqueous halide solution and an aqueous silver salt solution of a constant halide composition to the reaction vessel. The microscopic heterogeneous distribution of halide can be easily confirmed by observing the transmitted images of the silver halide grains using a transmission type electron microscope.

For example, the microscopic heterogeneous distribution can be observed by the direct method using a transmission type electron microscope at low temperature described in J. F. Hamilton, *Photographic Science and Engineering*, Vol 11, 57(1967) and Takekimi Shiozawa, *Journal of the Society of Photographic Science and Technology of Japan*, Vol. 35, No. 4, 213(1972). That is, silver halide grains released from a silver halide emulsion under a safelight such that the silver halide grains are not printed out are placed on a mesh for electron microscopic observation and the grains are observed by a transmission method in a state of being cooled by liquid nitrogen or liquid helium for preventing the silver halide grains from being damaged (i.e., printed out) by electron rays.

In this case, the higher the acceleration voltage of the electron microscope is, a clearer transmitted image is obtained, but it is preferred that the voltage be about 200 kvolts up to a thickness of the silver halide grains of about 0.25 μm and be about 1,000 kvolts for a thickness of greater than 0.25 μm. Since the higher the acceleration voltage is, the greater the damage to the grains by the irradiated electron rays will be, it is preferred that the sample being observed is cooled by liquid helium as opposed to liquid nitrogen.

The photographing magnification can be properly changed by the grain sizes of the sample being observed, but is usually from 20,000 to 40,000 magnifications.

In silver halide grains composed of a single halide, there cannot be, as a matter of course, a heterogeneity in the halide distribution and hence only flat images are obtained in a transmission type electron microphotograph. On the other hand, in the case of mixed crystals composed of plural halides, a very fine annular ring-form striped pattern is observed.

For example, in the transmission type electron microphotograph of tabular silver iodobromide grains, a very fine annular ring-like striped pattern is observed at the portion of the silver iodobromide phase. The tabular grains were formed by using tabular silver bromide grains as the cores and forming a shell of silver iodobromide containing 10 mol % silver iodide on the outside of the core, and the structure thereof can be clearly observed by the transmission type electron microphotograph. That is, since the core portion is silver bromide and, as a matter of course, homogeneous, a homogeneous flat image only is obtained in the core portion. On the other hand, in the silver iodobromide phase, a very fine annular striped pattern can clearly be observed.

The interval of the striped pattern is very fine, e.g., along the order of 100 Å or lower, which shows a very microscopic heterogeneity.

It can be clarified by various methods that the very fine striped pattern shows the heterogeneity of a halide distribution, but in a direct method, it can be concluded that when the grains are annealed under the condition capable of moving iodide ions in the silver halide crystal (e.g., for 3 hours at 250° C.), the striped pattern completely vanishes.

No annular striped pattern is observed in the tabular silver halide grains prepared by the process of this invention and silver halide grains having a completely homogeneous silver iodide distribution is obtained in this invention. The site of the phase containing silver iodide in the grains may be the center of the silver halide grain, may be present throughout the whole grain, or at the outside of the grain. Also, the phase wherein silver iodide exists maybe one or plural.

Details of these techniques are described in Japanese Patent Applications 63-7851, 63-7852, and 63-7853. These inventions relate to the growth of grains, but the same effect is also apparent in the nucleus growth in this invention.

The silver iodide content in the silver iodobromide phase or the silver iodochloride phase contained in the silver halide grains produced by the process of the invention is from 2 to 45 mol %, and preferably from 5 to 35 mol %. The total silver iodide content is more than about 2 mol %, more preferably at least 7 mol %, and particularly preferably at least 12 mol %.

This invention is useful in the production of silver chlorobromide grains and by the process, silver chlorobromide grains having a completely homogeneous silver bromide (silver chloride) distribution can be obtained. In this case, the content of silver chloride is at least 10 mol %, and preferably at least 20 mol %.

Furthermore, this invention is also very effective in the production of pure silver bromide or pure silver chloride. According to a conventional production process, the existence of a local variation of silver ions and halogen ions in a reaction vessel is unavoidable, the silver halide grains in the reaction vessel are brought into a different circumstance with respect to other portions by passing through such a locally heterogeneous portion. Hence, not only the heterogeneity of the grain growth occurs, but also reduced silver or fogged silver is formed in, for example, a highly concentrated portion of silver ions. Accordingly, in silver bromide or silver chloride, the occurrence of the heterogeneous distribution of the halide cannot take place, but another form of heterogeneity, as described above, occurs.

This problem is completely solved by the process and apparatus of this invention.

The silver halide grains obtained by the process of this invention can be, as a matter of course, used for a surface latent image type silver halide emulsion and can also be used for an internal latent image-forming type emulsion and a direct reversal emulsion.

In general, the internal latent image-forming type silver halide grains are superior to surface latent image-forming type silver halide grains in the following respects.

(1) A space charge layer is formed in silver halide crystal grains, electrons generated by light absorption move to the interior of the grain, and positive holes move to the surface. Accordingly, if latent image sites (electron trap sites), i.e., sensitive specks, are formed in the interior of the grains, the occurrence of the recombinations of the electron and the positive hole is prevented, thereby the latent image formation is performed at a high efficiency and a high quantum sensitivity is realized.

(2) Since the sensitive specks exist in the interior of the grains, the silver halide grains are not influenced by moisture and oxygen, and thus are excellent in storage stability.

(3) Since the latent images formed by light exposure exist in the interior of the grains, the latent images are not influenced by moisture and oxygen, and the latent image stability is also very high.

(4) When the silver halide emulsion is color or spectrally-sensitized by adsorbing one or more sensitizing dyes on the surface of the silver halide grains of the emulsion, the light absorption sites (i.e., one or more sensitizing dyes on the surface of the grains) are separated from the interior latent image sites. Thus, .the recombination of the dye positive holes and electrons is inhibited to prevent specific desensitization of the color sensitization, and a high color-sensitized sensitivity is thereby realized.

The internal latent image formation type silver halide grains have the aforementioned advantages as compared to surface latent image-forming type silver halide grains. However, the silver halide grains have difficulty in the formation of sensitive specks in the interior of the grains. For forming sensitive specks in the interior of silver halide grains, after once forming silver halide grains as core grains, a chemical sensitization is applied to the grains to form sensitive specks on the core surfaces. Thereafter, silver halide is precipitated or deposited on the cores to form so-called shells thereon. However, the sensitive specks on the surface of the core grains obtained by the chemical sensitization of the cores are liable to change during the formation of the shells and are liable to frequently form inside fog. One of the reasons for this is that if the shell formation on the cores occurs at the heterogeneous portion of concentrations (silver ion concentration and halogen ion concentration) as in a conventional technique, the shells are damaged and the sensitive specks are liable to be changed into fogged nuclei. On the other hand, according to the process of this invention, the aforesaid problem is solved and an internal latent image forming type silver halide emulsion having much less inside fog is obtained.

For the internal latent image-forming type silver halide grains, normal crystal grains and tabular grains are preferred, and the silver halide thereof is silver bromide, silver iodobromide and silver chlorobromide or silver chloroiodo-bromide having a silver chloride content of less than 30 mol % and is preferably silver iodobromide having a silver chloride content of less than 10 mol %.

In this case, the mol ratio of core/shell may be optional, but is preferably from 1/20 to ½, and more preferably from 1/10 to ⅓.

Also, in place of the internal chemically sensitized nuclei, a metal ion can be doped to the inside of the grains with the nuclei. The doping site may be the core, the core/shell interface, or the shell.

As the metal dopant, cadmium salts, lead salts, thallium salts, erbium salts, bismuth salts, iridium salts, rhodium salts or the complex salts thereof can be used. The metal ions are usually used in an amount of at least $10^{-6}$ mol per mol of silver halide.

The silver halide nucleus grains obtained by the process and apparatus of this invention further grow into silver halide grains having the desired grain sizes and a desired halide composition by performing the grain growth thereafter.

When the silver halide being grown is, in particular, mixed crystals such as silver iodobromide, silver iodochloro-bromide, silver chlorobromide, or silver iodochloride, it is preferred to perform the grain growth by the process and apparatus of this invention in succession to the formation of the nuclei.

Also, if necessary, it is preferred to perform the grain growth by adding a previously prepared fine grain silver halide emulsion to the reaction vessel. The details of the process are described in Japanese Patent Applications 63-7851, 63-7852, and 63-7853.

The silver halide grains thus obtained by the process and apparatus of this invention have the "completely homogeneous" halide distribution in both the nuclei and the grown phases of the grains and also the grain size variation thereof is very small.

There is no particular restriction on the mean grain size of the completely homogeneous silver halide grains obtained by the process and apparatus of this invention, but the mean grain size is preferably at least 0.3 μm, more preferably at least 0.8 μm, and particularly preferably at least 1.4 μm.

The silver halide grains obtained by the process and apparatus of this invention may have a regular crystal form (normal crystal grains) such as hexahedral, octahedral, dodecahedral, tetradecahedral, tetracosahedral, and octacontahedral, an irregular crystal form such as spherical and potato-form, or various forms having at least one twin plane, in particular, hexagonal tabular twin grains or triangular tabular twin grains having two or three parallel twin planes.

The silver halide photographic emulsion obtained by the process and apparatus of this invention can be used for various silver halide photographic materials and various additives, the photographic processing process thereof, etc., are described in JP-A-63-123042, 63-106745, 63-106749, 63-100445, 63-71838, 63-85547, *Research Disclosure*, Vol. 176, No. 17643, *ibid.*, Vol. 187, No. 18716.

The particular portions of the *Research Disclosures (RD)* are shown in the following table.

| | Additive | RD 17643 | RD 18716 |
|---|---|---|---|
| 1. | Chemical Sensitizer | p. 23 | p. 648, right column |
| 2. | Sensitivity Increasing Agent | | p. 648, right column |
| 3. | Spectral Sensitizer, Super Color Sensitizer | pp. 23–24 | p. 648, right column–p. 649 right column |
| 4. | Whitening Agent | p. 24 | |
| 5. | Antifoggant and | pp. 24–25 | p. 649, right column |

-continued

| | Additive | RD 17643 | RD 18716 |
|---|---|---|---|
| | Stabilizer | | |
| 6. | Light Absorber, Filter Dye, Ultraviolet Absorber | pp. 25-26 | p. 649, right column-p. 650, left column |
| 7. | Stain Inhibitor | p. 25, right column | p. 650, left to right columns |
| 8. | Dye Image Stabilizer | p. 25 | |
| 9. | Hardening Agent | p. 26 | p. 651, left column |
| 10. | Binder | p. 26 | p. 651, left column |
| 11. | Plasticizer, Lubricant | p. 27 | p. 650, right column |
| 12. | Coating Aid, Surface Active Agent | pp. 26-27 | p. 650, right column |
| 13. | Antistatic Agent | p. 27 | p. 650, right column |
| 14. | Color Coupler | p. 28 | pp. 647-648 |

Examples of this invention are shown below together with comparison examples.

COMPARISON EXAMPLE 1

As in the conventional process described in U.S. Pat. No. 4,758,505, 5 liters of an aqueous 2% gelatin solution in a reaction vessel was supplied to a mixer at a flow rate of 500 ml/min., an aqueous solution of 1.2 moles of silver nitrate and an aqueous solution of 1.2 moles of potassium bromide were supplied to the mixer at 100 ml/min. each, and they were mixed by rotating the stirrer of the mixer at 5000 r.p.m. to form silver iodobromide, fine grains. The reaction mixture formed in the mixer was introduced into a ultrafiltration device disposed in the route connecting the mixer and the reaction vessel to remove part of the water and the water-soluble components at an inside pressure of 1 kg/cm$^2$ and the mixture which remained was circulated to the reaction vessel. This operation was performed for 10 minutes in the aforesaid state. Also, the mixture in the reaction vessel was stirred by a stirring propeller provided therein.

EXAMPLE 1

In the example, the system as shown in FIG. 2 was used, 2 liters of water was previously placed in the reaction vessel, and the water was circulated from the reaction vessel through a conduit for passing the water through an ultrafiltration membrane and returned to the reaction vessel at a flow rate of 500 ml/min. A mixer is connected through other conduits to allow the addition of: an aqueous solution of 1.2 mols of silver nitrate, an aqueous solution of 1.2 mols of potassium bromide, and an aqueous 2% gelatin solution to the mixer under the same conditions as in Comparison Example 1, and the solutions were mixed at a rotation number of 5000 r.p.m. to form fine silver bromide grains. In addition, the addition of the solutions was performed for 10 minutes as in the case of the above comparison example. The reaction mixture was immediately supplied to the reaction vessel. A part of the reaction mixture in the reaction vessel was drawn therefrom by the pump 20, and after being filtered by the ultrafiltration device 12, was mixed in a mixer 21 with the reaction mixture supplied from the mixer 7, and the mixture was supplied to the reaction vessel 1. The solution in the reaction vessel was stirred under the same conditions as above.

COMPARISON EXAMPLE 2

The same procedure as in Example 1 was followed without employing the ultrafiltration.

For comparing the result of the aforesaid example and the results of the comparison examples, the amount of water removed by the ultrafiltration membrane, and the grain sizes of the silver halide grains directly after formation in the mixer and after performing the crystal growth in the reaction vessel in each case were measured and evaluated.

In addition, sampling by the electron microscopic observation was performed as follows. For evaluating the grain sizes of the grains directly after the reaction in the mixer 7, the reaction mixture was sampled, by a sampling valve disposed directly after the mixer, after one minute and 9 minutes had elapsed since the initiation of the addition of the solutions. Also, for evaluating the grain sizes of the silver halide grains after the crystal growth, the product in the reaction vessel was sampled after 20 minutes had elapsed since the addition of the reaction mixture to the reaction vessel. The sample was quickly cooled by liquid nitrogen for restraining the occurrence of crystal growth and was evaluated by a direct cooling electron microscope (20,000 magnification). The results obtained are shown in Table 1 below.

TABLE 1

| Sample | Amount of water ( ) removed | Grain size (μm) after mixer: After 1 min. | Grain size (μm) after mixer: After 9 min. | Grain size (μm) after crystal growth: Mean size | Grain size (μm) after crystal growth: Distribution |
|---|---|---|---|---|---|
| Comparison Example 1 | 1.84 | 0.19 | 0.89 | 1.12 | ±0.41 |
| Example 1 | 2.02 | 0.02 | 0.02 | 0.84 | ±0.12 |
| Comparison Example 2 | 0 | 0.02 | 0.02 | 0.46 | ±0.10 |

As is clear from the results shown in Table 1, in Comparison Example 2 and Example 1 wherein the liquid in the reaction vessel was circulated into the mixer disposed outside of the reaction vessel, very fine silver halide grains could be formed in the mixer as compared with Comparison Example 1 wherein the liquid in the reaction vessel was not circulated into the mixer. It is also shown by the difference in the size distribution after the crystal growth that the crystal growth can be very uniformly performed in the subsequent reaction vessel in the case of using the very fine silver halide grains.

Also, in the comparison of Comparison Example 2 and Example 1, the mean grain size of the silver halide grains after the crystal growth in Example 1, wherein the liquid from the reaction vessel was concentrated using the ultrafiltration membrane, was larger than the mean grain size of the grains in Comparison Example 2, wherein the concentration of the liquid was not performed, while the grain size distribution was almost same in both examples. That is, the results show that the crystal growth is accelerated by concentrating the circulating liquid.

Furthermore, although the results are not shown in Table 1, the yield of the fine grains per unit volume of the aqueous solutions added to the mixer was greatly increased by the concentration of the liquid from the reaction vessel in Example 1 as compared with the yield in Comparison Example 2.

As described above, according to the process of this invention, the following effects are obtained.

(1) By separating the reaction vessel for performing the crystal growth of silver halide grains from the mixer for forming fine silver grains, homogeneous grains are always stably formed.

(2) Since the liquid in the reaction vessel is concentrated, the yield of the silver halide grains per unit volume of the solutions added to the mixer is increased.

(3) The sizes of fine grains formed in the mixer are reduced by diluting the aqueous silver salt solution and the silver halide solution in the mixer, but there is a restriction on the volume of the reaction vessel by the practical yield for the amounts of the solutions added. However, since according to the process of this invention, the concentrated solution is supplied to the reaction vessel, the restriction is removed and more fine grains are formed in the mixer, thereby more homogeneous crystal growth is possible.

(4) By concentrating the liquid drawn from the reaction vessel and also instantly and uniformly mixing the concentrated liquid with the reaction mixture supplied from the mixer in a system for connecting the mixer and the reaction vessel, the physical ripening time is reduced and the homogeneous crystal growth is increased.

(5) The grain size distribution of silver halide grains produced is narrowed.

The embodiment of FIG. 4 of the invention is further explained by the following example.

In the system as shown in FIG. 4, wherein an aqueous solution of 0.1 mole of silver nitrate and an aqueous solution of 0.5 mole of potassium bromide were added to the mixer 7 disposed outside of the reaction vessel 1 at a flow rate of 50 ml/min. each to cause the reaction. Silver halide grains were formed by changing the flow rate and the concentration of an aqueous gelatin solution for dilution being added to the mixer during the reaction, and the grain sizes of the fine grains formed were evaluated. For the evaluation, a transmission type electron microscope (20,000 magnification) by direct method was used. Also, in this case, for preventing the grains from causing grain growth from the time of sampling to the time of measurement, the sampled grains were cooled by liquid nitrogen directly after sampling.

The results obtained are shown in Table 2 below.

TABLE 2

| Test No. | Condition of Aqueous Gelatin Solution: Concn. (%) | Condition of Aqueous Gelatin Solution: Flow Rate (ml/min.) | Mean Grain Size (μm) |
|---|---|---|---|
| 1 | — | | 0.31 |
| 2 | 2 | 100 | 0.05 |
| 3 | 2 | 200 | 0.03 |
| 4 | 1 | 200 | 0.04 |
| 5 | 2 | 300 | 0.01 |
| 6 | 0.67 | 300 | 0.02 |

In the above table, Test No. 1 was the case where an aqueous gelatin solution was not added to the mixer.

As is clear from the above results, it can be seen that as the amount of an aqueous gelatin solution for dilution added to the mixer is larger, the mean grain size of the silver halide grains formed in the mixer is finer.

Then, each of the reaction mixtures in Test Nos. 2 through 6 was supplied to the reaction vessel containing an aqueous gelatin solution to perform the crystal growth of the silver halide grains and, in this case, a concentration test was performed by concentrating each reaction mixture by an ultrafiltration device before supplying to the reaction vessel. The filtration test was performed using Module AIL1050 (trade name, made by Asahi Chemical Industry Co., Ltd.) as the ultrafiltration membrane at an inside pressure of 1.5 kg/cm$^2$. The results showed that in each test of 30 minutes, water could be removed at a mean rate of 200 ml/min.

Thus, on comparing the results of Test No. 3 and the results of Test No. 5, it can be seen that if in the case of Test No. 5 wherein the amount of the aqueous gelatin solution added to the mixer is 1.5 times that in Test No. 3, the amount of the liquid (reaction mixture) being supplied from the mixer to the reaction vessel is reduced to the amount of the liquid in Test No. 3 using the ultrafiltration membrane, the reaction mixture containing the fine grains having a mean grain size of about ⅓ of that in Test No. 3 can be supplied to the reaction vessel under the same condition as in Test No. 3.

Accordingly, by concentrating the reaction mixture being supplied from the mixer to the reaction vessel using an ultrafiltration membrane, etc., a large amount of an aqueous gelating solution for dilution can be supplied to the mixer, thereby finer silver halide grains can be formed in the mixer, which is advantageous for the homogeneous crystal growth of silver halide grains in the reaction vessel. Further, since the reaction mixture being supplied to the reaction vessel can be concentrated in this invention, the yield for the silver halide grains grown in the reaction vessel per unit amount of raw materials used can be increased.

The advantages of the above embodiment of the present invention are as follows:

(1) In the case of not using a concentration means such as an ultrafiltration membrane, etc., for concentrating the reaction mixture being supplied to a reaction mixture, it is impossible to increase the yield for the silver halide grains formed in a reaction vessel by the restriction of the capacity of the reaction vessel. However, according to the present invention, the reaction mixture from the mixer can be diluted and thus the aforesaid yield can be improved.

(2) Also, with this embodiment, finer silver halide grains can be formed in a mixer by forming the fine grains in a state sufficiently diluted with an aqueous protective colloid solution and in the case of forming such finer silver halide grains in the mixer, the yield for the silver halide grains grown in a reaction vessel is not reduced by concentrating the reaction mixture formed in the mixer before entering the reaction vessel.

(3) Furthermore, since with this embodiment, the reaction mixture containing silver halide fine grains being supplied to a reaction vessel is concentrated, the grain growth in the reaction vessel is accelerated, which results in shortening the growing time of silver halide grains in the reaction vessel.

By the process and apparatus of the above embodiment, completely homogenized silver halide grains can be formed, thereby, as a matter of course:

1) Silver halide grains having a completely homogeneous halogen distribution are obtained as compared with silver halide grains obtained by conventional systems;

2) Silver halide grains formed have less fog; and

3) A silver halide emulsion excellent in sensitivity, gradation, graininess, sharpness, storage stability, and pressure resistance is obtained.

What is claimed is:

1. A process for producing silver halide grains comprising the steps of:

disposing a mixer having a stirrer outside of a reaction vessel containing an aqueous protective colloid solution and causing at least one of a nucleus formation and a crystal growth of silver halide grains in the reaction vessel;

supplying at various flow rates an aqueous solution of a water-soluble silver salt, an aqueous solution of a water-soluble halide, and an aqueous solution consisting essentially of a protective colloid to the mixer while controlling the flow rates of the aqueous solutions;

mixing the aqueous solutions while controlling a rotational speed of said stirrer to form a reaction mixture including fine, silver halide grains;

immediately supplying the fine grains thus formed to the reaction vessel to perform said at least one of the nucleus formation and the crystal growth of the silver halide grains in the reaction vessel; and further comprising mixing the reaction mixture being supplied from the mixer through a conduit to the reaction vessel with a liquid drawn from the reaction vessel and added to the conduit extending between the mixer and the reaction vessel, and after removing a portion of water and water-soluble components from the reaction mixture, supplying the reaction mixture to the reaction vessel.

2. The process of producing silver halide grains according to claim 1, wherein said portion of water and water-soluble components is removed from the liquid drawn from the reaction vessel before the liquid is mixed with the reaction mixture from the mixer.

3. A process of producing silver halide grains comprising the steps of:

disposing a mixer having a rotatable stirrer outside of a reaction vessel containing an aqueous protective colloid solution and causing at least one of a nucleus formation and a crystal growth of silver halide grains in the reaction vessel;

supplying at various flow rates an aqueous solution of a water-soluble silver salt, an aqueous solution of a water-soluble halide, and an aqueous solution consisting essentially of a protective colloid to the mixer while controlling the flow rates of the aqueous solutions, without any recycling of the aqueous solutions protective colloid solution from the reaction vessel to the mixer taking place for the duration of said process;

mixing the aqueous solutions while controlling the rotational speed of the stirrer to form a reaction mixture including fine, silver halide grains; and immediately supplying the fine grains to the reaction vessel; and further comprising removing a portion of water and water-soluble components from the reaction mixture containing the fine grains supplied from the mixer before the reaction mixture is supplied to the reaction vessel to form a concentrated reaction mixture, and supplying the concentrated reaction mixture to the reaction vessel.

* * * * *